United States Patent [19]

Weir et al.

[11] Patent Number: 4,797,957

[45] Date of Patent: Jan. 17, 1989

[54] SWIMMING POOL WITH IMPROVED WALL STRENGTHENING MEANS

[75] Inventors: Donald H. Weir, York; Charles F. Robinson, Felton, both of Pa.

[73] Assignee: Fox Pool Corporation, York, Pa.

[21] Appl. No.: 592,309

[22] Filed: Mar. 22, 1984

Related U.S. Application Data

[63] Continuation-in-part of Ser. No. 349,501, Feb. 17, 1982, abandoned.

[51] Int. Cl.[4] ..... F04H 3/18

[52] U.S. Cl. ..... 4/506

[58] Field of Search ..... 4/506–513; 52/169.1, 169.7, 169.8, 300

[56] References Cited

U.S. PATENT DOCUMENTS

| | | | |
|---|---|---|---|
| 3,094,709 | 6/1963 | Miccio et al. | 52/167.7 |
| 3,225,362 | 12/1965 | Barrera | 52/169.1 |
| 3,239,975 | 3/1966 | Steir | 52/169 |
| 3,242,624 | 3/1966 | Steir | 52/169 |
| 3,511,002 | 5/1970 | Fox | 52/146 |
| 3,745,593 | 7/1973 | Wall | 52/300 X |
| 3,793,651 | 2/1974 | Pitti et al. | 52/300 X |
| 3,955,220 | 5/1976 | Kessler | 4/506 X |
| 4,020,509 | 5/1977 | West | 4/506 X |
| 4,182,087 | 1/1980 | Schall et al. | 4/506 X |

FOREIGN PATENT DOCUMENTS

| | | | |
|---|---|---|---|
| 2344952 | 10/1975 | Fed. Rep. of Germany | 4/506 |

*Primary Examiner*—Charles E. Phillips

*Attorney, Agent, or Firm*—Arthur J. Plantamura

[57] ABSTRACT

An arrangement comprising a plurality of wall panels connected end-to-end to form the swimming pool is strengthened and is afforded with means to retain alignment, and prevents the wall panels from buckling. Horizontal stiffening members are positioned in cut-outs formed in vertical support posts secured to the panels and in the vertical flanges at the ends of the panel modules to which brace members are also attached. The stiffening members are contained within the cut-outs and abut against the back of the wall panel at the top. Vertical Z-shaped post or rib members secured to the modular panels are provided with a bottom tab which may be staked in position facilitates alignment of the panels. A longitudinal stiffening member positioned at the bottom of the wall panels is optionally used and adds substantial additional strength and alignment means to the pool structure.

8 Claims, 2 Drawing Sheets

SWIMMING POOL WITH IMPROVED WALL STRENGTHENING MEANS

This application is a continuation in part of the U.S. application Ser. No. 349,501 filed on Feb. 17, 1982 now abandoned.

This invention relates to improved swimming pool construction and more particularly to a swimming pool with wall panel strengthening means which prevents buckling and/or misalignment of a swimming pool wall which is fabricated from a plurality of wall panels secured end-to-end around the periphery of a pool.

BACKGROUND OF THE INVENTION

Various constructions which employ an assembly of modular panels connected end-to-end to form the perimeter of the pool are known. In addition to being secured by various means at the ends, these swimming pool wall panels, for the most part, employ some supporting or bracing structure to retain the wall panels in a vertical position. Generally, such means include brace members which extend outwardly from the panel in a plane perpendicular to the panel. Such braces are spaced generally at the points where panels are connected and at appropriate intervals between the ends of the panels. However, even with positioning of such braces at frequent intervals on the panels, a structure which adds significantly to the cost when the number of braces is relatively high, the pool wall panels still have a considerable tendency to buckle and misalign while the assembly is taking place after being initially positioned and when concrete is poured or backfill is added.

It is thus apparent that a need exists for an improved swimming pool wall panel stiffening and bracing system and for means that aid in retaining positive alignment of the pool wall formed from an array of assembled modular wall panels.

SUMMARY OF THE INVENTION

The object of the invention resides in providing a swimming pool with an improved stiffening and alignment retaining means for swimming pools that are constructed from an assemblage of modular wall panels that are secured end-to-end to form the pool enclosure and which are primarily and preferably formed from, but need not be limited to, sheet metal modules.

This and other objects of the invention are attained by injecting horizontal stiffening members in cut-out portions formed for this purpose in the top of the end flanges that are formed at the ends of the wall panels and in cut-out portions formed in the vertical posts that are preferably welded but may be otherwise attached to the modular wall panels. The horizontal stiffening member is contained in the cut-out portion at the top of the vertical posts or flanges so that the top of the stiffening member is substantially flush with the top of the wall panels. The vertical posts are preferably formed so as to have a Z cross section to provide a combination of ease of use and optimum strength. A tab formed and extending laterally from the bottom of the Z post is arranged to receive an anchoring pin which secures the aligned panel in position. Supplementing the stiffening and alignment of the wall panels a longitudinal stiffening member, which may be conveniently an angle iron is positioned at the bottom of and secured to the panel and receives therein a staking pin to secure the panels to the substrate and hold them in alignment.

These and other features and advantages of the invention will be better understood and appreciated from a consideration of the following detailed description taken in conjunction with the accompanying drawing.

DETAILED DESCRIPTION OF THE INVENTION

Figure 2:
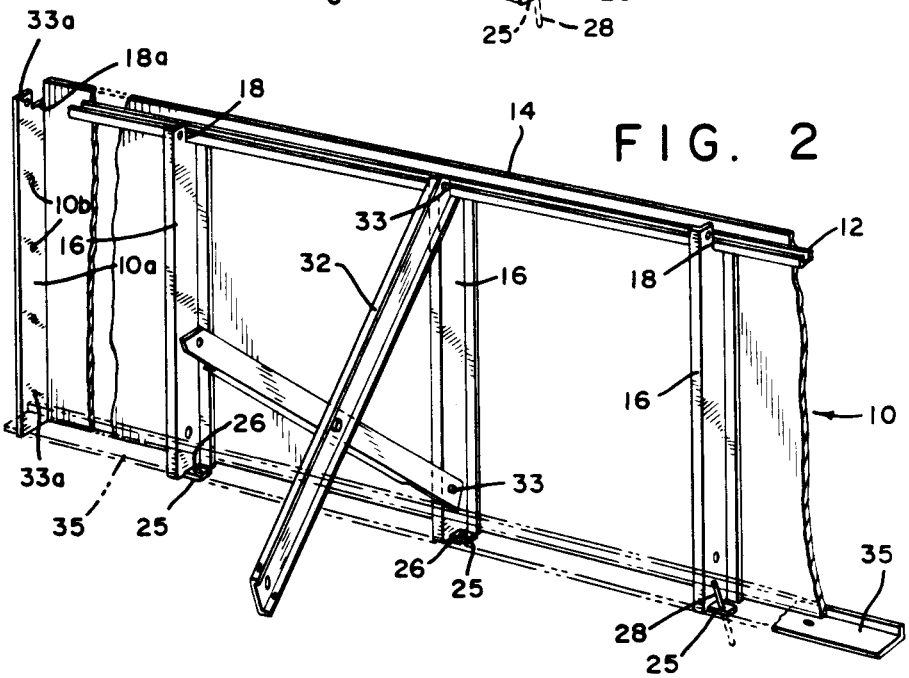
FIG. 2 is a perspective view of a fragmentary portion of a swimming pool wall and associated horizontal top and bottom stiffening members and vertical post with alignment tabs seen from a point outside the pool.
Figure 3:
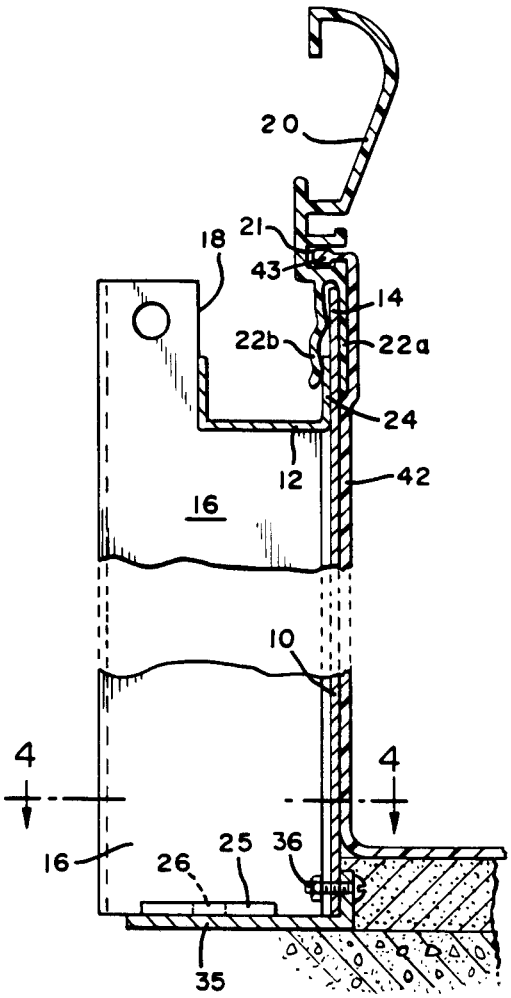
FIG. 3 is a sectional elevation enlarged view of a swimming pool wall showing the side of a vertical post with a cut-out formed in the top of the post and with bottom alignment tab, and with an upper horizontally extending U-shaped stiffener member in the cut-out, a lower angle iron stiffener and with a coping in place over the top edge of the wall and U-brace.
Figure 4:
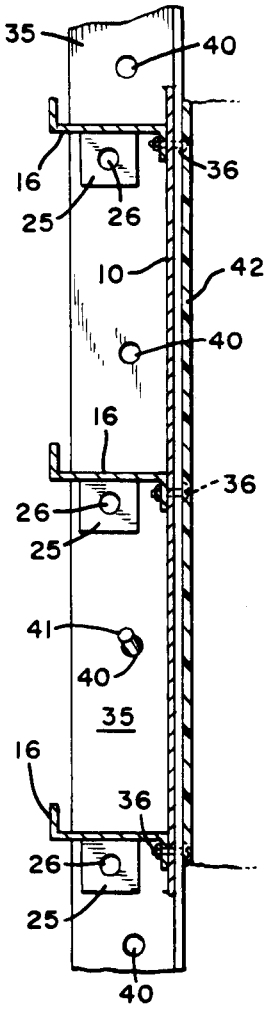
FIG. 4 is a sectional view taken along line 4—4 of FIG. 3.

In order to provide stiffness for the swimming pool side wall, the modular wall panel 10 is supported with a longitudinally extending stiffening member 12, which is preferably formed so as to have a U-shape cross section secured along the upper edge 14 of the wall. The panels 10 are formed at the ends with a flange **10*a* by bending the ends of panel 10. This facilitates securing adjacent panels to each other and to the brace such as by bolts secured in openings 10*b* and 33*a*, respectively. The member 12 may, of course, be formed of other cross section such as L-shaped angle members or it may be cylindrical. A plurality of horizontally spaced vertical stiffening posts or Z braces 16 are secured, such as by welding, to the panel 10 in spaced relation to each other, such as at intervals of about two feet. Each of these Z brace members is formed with a cut-out 18 at its top end, as best seen in FIG. 3, to accommodate, within the cut-out 18 the stiffening member 12. Similarly, the flanged ends of a panel are likewise provided with a cut-out 18*a* as best seen in FIG. 2 also to receive within the cut-out 18*a* the member 12. The cut-out portions 18 and 18*a* are formed at the front end of the top of the post so that the stiffening member 12 abuts against the back of and at the top of the wall panel 10. The cut-out portions are of sufficient depth to contain the stiffening member 12 so that the top of the stiffening member is flush with, or at least does not extend above, the top of the wall panel. A coping 20 having a suitable bifurcated lower portion, i.e. an inner leg 22*a* and an outer leg 22*b*, receives the upper edge 14 of the wall 10 together with the upwardly projecting inner leg or side 24 of the horizontal longitudinal U-shaped stiffening member 12 as best seen in FIG. 3. The Z shaped vertical post 16 is preferably provided with a tab 25 at its lower end with a hole 26 therein to receive a stake 28** for securing and retaining the wall of the swimming pool in alignment.

Figure 1:
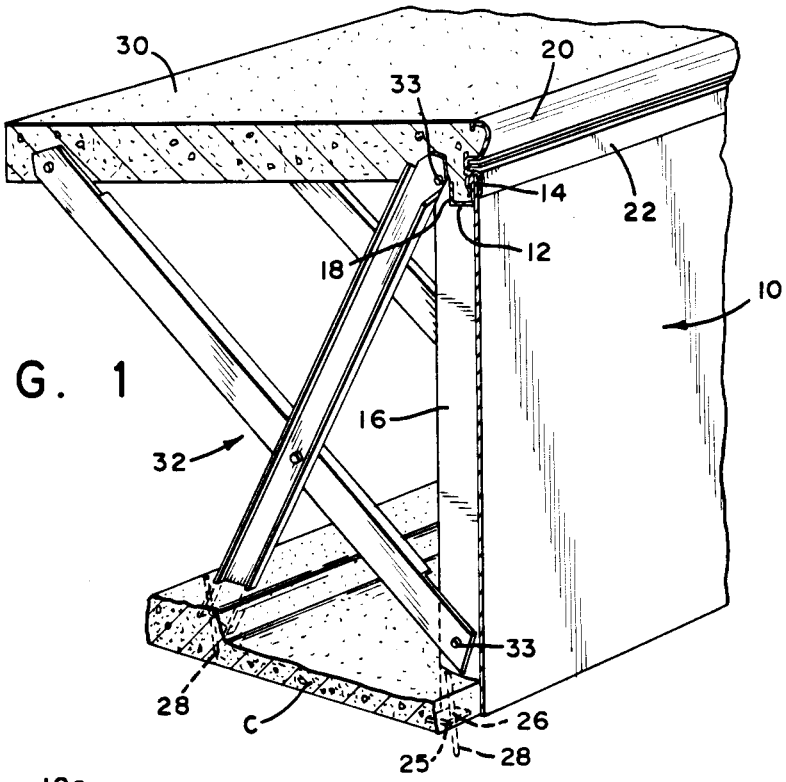
FIG. 1 is a perspective view, partly in sectional elevation, of a fragmentary portion of a swimming pool wall and deck illustrating the edge of the upper stiffening member inserted in a cut-out at the top of a vertical post, a brace and footing.

As will become apparent by reference to FIG. 1, the stiffening member 12 is designed to receive poured concrete during the forming of a deck 30 which is conventionally formed so as to partially or entirely surround the pool. The concrete also enters the interior of the coping 20 to secure the entire top of the wall and posts and the stiffener 12 in a unitary structure. The structure is further supported and secured by use of a plurality of crossed braces 32 positioned at properly spaced intervals along the outside of the wall 10 and suitably fastened such as by bolts 33 to the vertical posts 16 and end panel flanges 10*a*. Concrete C is also applied at the bottom of the wall 10, to form footing and sufficient in amounts to cover the anchor pins 28 and tab 25, as well as the bottom of the outer leg of brace 32.

Further stiffening of the panels 10 can be accomplished by using, additionally, a stiffening member 35 which may conveniently comprise an L-shaped cross section and which is positioned at the bottom of the wall panel 10 as best shown in FIG. 3. The member 35 is secured from the front (i.e. the interior side of the pool) such as by bolts 36. The horizontal bottom stiffening member 35 extends longitudinally bordering the bottom edge of the wall panels and is positioned substantially parallel to the stiffener 12 at the top of the panel. To retain alignment of the pool wall, stakes 28 are driven into the ground through spaced holes 40 that are formed in the angle member 35 at suitably spaced intervals. The bottom stiffening member 35 is provided with a plurality of holes 40 so that it can be anchored at any of various suitable placed. When the bottom stiffening member 35 is employed, use of the stake 28 secured through the tab 25 is optional. Use of the stiffener member 35 of itself affords ample retention of the wall. In the embodiment utilizing the horizontal bottom stiffening member 35 (FIG. 3), poured concrete C sufficient to cover the stiffening member 35 that is attached to the bottom of the panel 10 is applied. A layer of sand is then applied inside the pool bottom as a protective intermediate base upon which the vinyl pool liner 42 rests.

The strengthening features which have been described afford a pool with much improved ruggedness and substantially obviate all significant buckling in the pool wall. Additionally, the anchoring, by means of a stake driven through the tabs 25, formed at the bottom of the vertical posts which are welded to the pool wall panel, holds the pool securely in alignment. Even before backfill and poured concrete are applied to permanently set the pool wall, the pool wall supported in accordance with strengthening and anchoring means of the invention, as above described, is self-sustaining and may be worked around without danger that its alignment will be disturbed while the preliminaries of construction other than the poured concrete are completed. This arrangement of self-supported wall panels, stiffened in accordance with the invention affords, also, a construction having substantially optimum stress distribution in the pool in a most simple and inexpensive manner.

The following describes the installation of a below-ground pool in accordance with the advantageous structure of the invention. Once the site on which the pool is to be installed is excavated, the pool outline is marked and the wall panels 10 on which the end flanges 10*a* are formed and the Z posts 16 are welded are erected using suitable bracing means such as cross braces 32 which are secured to the vertical posts or vertical Z members 16. The stiffening member 12 is then wedged into the cut-out portions 18 formed at the top of the vertical posts 16 and in the cut-out 18*a* at the top of the end flanges 10*a*. The pool wall is aligned and anchoring stakes 28 are driven through the holes 26 formed in the tab 25. Where the bottom optional stiffener 35 is to be applied, the angle member 35 is slipped under the bottom of the wall panels 10. Alternatively, the angle iron 35 may be laid in place at the site once the pool outline is marked and before the wall panels are placed in position, and then the panel modules 10 are deposited thereon and sheet metal screws used to fasten the stiffener 35 to panel 10. The wall is secured to the braces via the vertical posts, aligned and stakes 28 are driven through aligned holes 26 in the tab 25. When the bottom stiffening member 35 is employed, staking through the tabs 25 is optional because sufficient strength and rigidity is afforded by staking through holes 40 at appropriate intervals in stiffener 35. The coping 20 is then positioned over the top 14 of the wall panel. Preferably the legs 22*a* and 22*b* of coping 20 are of sufficient length so as to grip within these depending bifurcated legs not only the top of the wall 10 but also a leg of the stiffening member 12 locking the various parts in a rigid integral arrangement. It is important to provide a structural which prevents dislodgment of the top stiffening member 12 that the member 12 be contained within the cut-out 18 so that the top of the horizontal stiffener 12 not extend above the top edge 14 of the wall 10. This also facilitates gripping of a leg 24 of the stiffener 12 and top 14 of the wall panel within the depending legs of the coping 20. Once the posts are fully aligned and secured, concrete deck 30 is poured filling the voids including those in the channel member 12 and in the coping 20. A concrete footing sufficient to cover pins 28 (FIG. 1) or to cover member 35 (FIG. 3) is poured in place. A fine grain sand S is applied within the pool when the concrete is set to serve as a protective floor for the vinyl liner 42 whose retaining bead 43 is secured in channel 21 of the coping 20.

While the preferred embodiments of the invention have been disclosed in detail, it is to be understood that various alternative details or equivalents which fall within the scope of the invention as claimed may be adapted by those skilled in the art.

What is claimed is:

1. A below-ground swimming pool comprising an assemblage of metal side wall panels having vertical reinforcing posts welded at intermittent locations along the length of the panel side, said panels being joined in end-to-end relationship and being braced in upright position to form the perimeter of the swimming pool, a cut-out at the top of said posts for receiving in said cut-out a stiffening member horizontally positioned within said cut-out so that the top of said stiffening member is inset within said cut-out and is not higher than the top of said wall panel and not higher than the top of the post and is positioned in said cut-out such that the stiffening member abuts against the back of the said wall panel at the upper edge of the wall panel, bracing members secured on vertical posts at points contiguous to the top and to the bottom of said vertical posts and extending outward from said wall panels and secured in a footing and a poured concrete deck formed around the outer periphery of the pool and embedding therein the top of said bracing members, the top of the vertical posts containing said cut-out, the top of said wall panels and said stiffening member.

2. The improvement of claim 1 wherein the vertical post comprises a Z shaped cross section and said post is provided with an anchoring tab extending horizontally from the bottom of said post to permit anchoring of said post on a substrate on which the pool is assembled.

3. The improvement of claim 2 further provided with a longitudinally extending stiffening member positioned at the bottom of and secured to said panels and means for anchoring said stiffening member to the underlying substrate.

4. The improvement of claim 3 wherein said bottom stiffening member has an L-shaped cross section with an upright leg secured to the panel from the front and a horizontal leg at the bottom which is provided with a plurality of anchoring openings.

5. The improvement of claim 1 wherein the wall panels are provided with substantially right angle end flanges which abut the end flanges of adjacent panels, said flanges having a cut-out at the top such that the cut-out is in alignment with the cut-out in the vertical reinforcing posts to accept therein the stiffening member that abuts against the upper edge of the wall panel.

6. The improvement of claim 1 wherein said stiffening member disposed horizontally in the cut-out at the top of said posts comprises a longitudinal channel member with an upward facing U-shaped cross section.

7. The improvement of claim 6 wherein a coping with depending bifurcated legs is inserted at the top of the side wall panels so that the said legs straddle, and grip therebetween, the top of the wall panel and a leg on the U-shaped stiffening member positioned within said cut-out.

8. A method of assembling a below-ground swimming pool from an assemblage of prefabricated metal side wall panels which have vertical posts that are substantially the height of the wall panel welded at intermittent locations along the length of the wall panel, forming a cut-out of a portion contiguous to the wall panel of the top of each of said posts, excavating a ground site, assembling said panels peripherally to form the pool enclosure in said ground site, securing outwardly extending bracing members on said vertical posts and on the ground, inserting a horizontal stiffening member within said cut-out portion to extend around and abut against the top and at the back of the wall panels, the top of said stiffening members being substantially flush with the top of the wall panels and co-extending around the periphery of the pool, affixing a coping around the periphery of the swimming pool, and at the top of said wall panels, pouring a concrete footing to secure in place at the bottom said posts and said bracing members and pouring a pool deck at the outer periphery of said pool to embed therein the tops of said bracing members and said vertical posts, said stiffening member and coping.

* * * * *